US006431790B1

(12) United States Patent
Anderegg et al.

(10) Patent No.: US 6,431,790 B1
(45) Date of Patent: Aug. 13, 2002

(54) METHOD OF MEASURING MECHANICAL DATA OF A SOIL, AND OF COMPACTING THE SOIL, AND MEASURING OR SOIL-COMPACTION DEVICE

(75) Inventors: Roland Anderegg, Olten; Hans-Ulrich Leibundgut, Kirchenthurnen, both of (CH)

(73) Assignee: Ammann Verdichtung AG, Langenthal (CH)

( * ) Notice: Subject to any disclaimer, the term of this patent is extended or adjusted under 35 U.S.C. 154(b) by 0 days.

(21) Appl. No.: 09/284,800

(22) PCT Filed: Oct. 21, 1997

(86) PCT No.: PCT/CH97/00396

§ 371 (c)(1),
(2), (4) Date: Apr. 21, 1999

(87) PCT Pub. No.: WO98/17865

PCT Pub. Date: Apr. 30, 1998

(30) Foreign Application Priority Data

Oct. 21, 1997 (CH) ..... 2559/96

(51) Int. Cl.[7] ..... E01C 23/07; E01C 19/38; E02D 3/02; B01F 11/00

(52) U.S. Cl. ..... 404/75; 404/84.1; 404/117; 405/271; 73/594; 366/116

(58) Field of Search ..... 404/117, 130, 404/75, 84.05, 84.1, 122; 73/573, 594; 405/271; 366/116

(56) References Cited

U.S. PATENT DOCUMENTS

| | | | | | |
|---|---|---|---|---|---|
| 4,103,554 | A | * | 8/1978 | Thurner | 73/573 |
| RE31,195 | E | * | 4/1983 | Thurner | 73/573 |
| 4,467,652 | A | * | 8/1984 | Sandstrom | 73/573 |
| 4,734,846 | A | * | 3/1988 | Konig | 364/153 |
| 5,164,641 | A | * | 11/1992 | Quibel et al. | 318/128 |
| 5,695,298 | A | * | 12/1997 | Sandstrom | 404/72 |
| 5,727,900 | A | * | 3/1998 | Sandstrom | 404/84.1 |

FOREIGN PATENT DOCUMENTS

| | | | | |
|---|---|---|---|---|
| EP | 0459062 | | 12/1991 | |
| WO | 94 20684 | | 9/1994 | |
| WO | 95 10664 | | 4/1995 | |
| WO | WO 95/10664 | * | 4/1995 | 404/84.1 |

* cited by examiner

*Primary Examiner*—Gary S. Hartmann

(57) ABSTRACT

Method and apparatus for compacting soil and for determining a mechanical characteristic of soil, including a method and apparatus for periodically compacting soil with a soil compacting device so as to make the soil and the soil compacting device vibrate together as a single oscillatory system, analyzing the vibration of the soil and soil compacting device, and adjusting an oscillatory driving force so as to drive the single oscillatory system towards a characteristic resonance frequency Ω.

12 Claims, 3 Drawing Sheets

METHOD OF MEASURING MECHANICAL DATA OF A SOIL, AND OF COMPACTING THE SOIL, AND MEASURING OR SOIL-COMPACTION DEVICE

This application is the national phase under 35 U.S.C. §371 of PCT International Application No. PCT/CH97/00396 which has an International filing date of Oct. 21, 1997 which designated the United States of America.

FIELD OF THE INVENTION

The invention relates to a method for measuring the mechanical data of a graded and tampered soil, or a soil that is to be graded and tampered, to a grading and tampering method in order to achieve optimal, in particular, homogeneous grading and tampering of a soil, to an apparatus for measuring the mechanical data of a graded and tampered soil, or of a soil that is to be graded and tampered, and to an apparatus for grading and tampering a soil in order to achieve optimal, homogeneous compacting of that soil.

DESCRIPTION OF RELATED ART

A method for soil grading and tampering is known in the art from WO 95/10664. With this known method, the frequency of a rotating unbalance is adjusted in such a way that the grader and tamper unit, which has contact with the ground that is to be graded and tampered, will not exceed a preset harmonic oscillation value - here twice the value of the fundamental oscillation. Staying below this preset value is defined as a stability criterion. Using two acceleration recorders, arranged vertically to each other on the grader and tamper unit, their accelerations are measured. One acceleration recorder measures the horizontal, the other measures the vertical acceleration component. Determined are the oscillation amplitude of the grader and tamper device, and the direction of the maximum compacting amplitude. The frequency of the eccentric, as well as its weight and the rolling speed are adjustable with the aid of a computer. However, these values are adjusted in such a way so as to avoid machine and chassis resonance. Adjustment of the eccentric's frequency and weight is carried out without accounting for the qualities of the soil that is to be graded and tampered. Based on the measured acceleration values, the modulus of elasticity in shear of the compacted soil and its plastic parameter are determined.

Another method for soil grading and tampering is known in the art from EP-A 0 459 062. With this known grading and tampering method, emphasis is placed on adjusting the machine parameters in such a manner that preset forces acting upon the the soil, which is to be graded and tampered, are achieved.

SUMMARY OF THE INVENTION

The object of the invention is to describe a method for measuring and/or grading and tampering a soil, and to create an apparatus for measuring and/or grading and tampering a soil which allows homogeneous soil compacting by using a grading and tampering method that requires as few equipment runs as possible; in particular, with a preset, desired soil rigidity and/or, in particular, a desired modulus of elasticity, and which allows the determination of mechanical data for the soil to be graded and tampered, or the graded and tampered soil.

The object of the invention is realized in that, in contrast to patent WO 95/10664, reliance is not placed on the local phase position of a maximum oscillation amplitude of a grading and tampering or measuring device, but instead reliance is placed on the temporal phase of the exciting oscillation of the eccentric(s) in relation to the phase of the excited oscillation of the soil grading and tampering and/or measuring systems, which is identical to the oscillation of the grading and tampering and/or the measuring devices. Also contrary to WO 95/10664, work is performed in the resonant range of an oscillation system, which consists of the grader and tamper or measuring device, acting upon the soil that is to be compacted (or has been compacted), and the soil. Although the soil grader and tamper apparatus described in EP-A 0 459 062 operates in the resonant range of its grader and tamper device, it is unable, however, to determine the soil rigidity $C_B$, which is reached with the compacting process, and is therefore not able to optimize the compacting process on the basis of these established values.

BRIEF DESCRIPTION OF THE DRAWINGS

To illustrate the invention, the following figures will describe a soil grader and tamper apparatus according to the invention. The soil grader and tamper apparatus includes a measuring device according to the invention for the purpose of determining the mechanical data that are essential for the compacting process. They show.

DETAILED DESCRIPTION OF THE INVENTION

Figure 1:
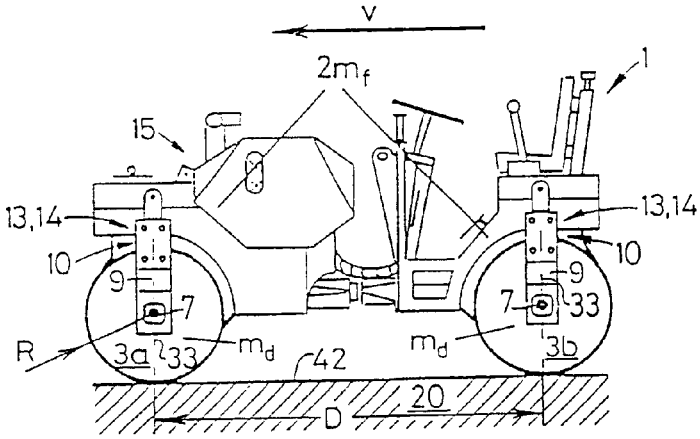
FIG. 1 a schematic depiction of a double tandem vibrating roller with center pivot steering, which allows soil grading and tampering according to the invention, FIG. 2 a mechanical equivalent circuit diagram, in terms of oscillation, of the soil grader and tamper apparatus described in FIG. 1, FIG. 3 a signal block wiring diagram for implementing the soil grading and tampering according to the invention, FIG. 4 a standardized oscillation amplitude of the soil grader and tamper device (ordinate) in accordance with FIG. 2 that is interdependent on a standardized oscillation frequency of the unbalance (abscissa), which excites the oscillation.

The double tandem vibrating roller 1 with center pivot steering, shown in FIG. 1, features a front surface and a back surface 3*a* and 3*b* that serve as the ground compacting devices. In the following descriptions only the one or the other of the two surfaces 3*a* and 3*b* will be considered, and both are designated with the reference number 3, if there is no difference between front and back surface 3*a* and 3*b*. A coupling between the two surfaces 3*a* and 3*b* in the context of the double tandem vibrating roller 1 described here, for example, is not relevant for the operating performance.

Figure 2:
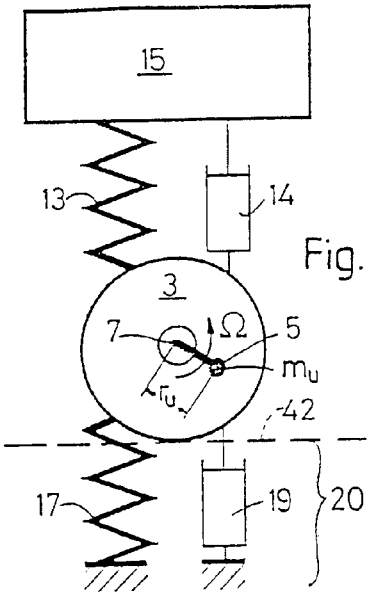
Figure 3:
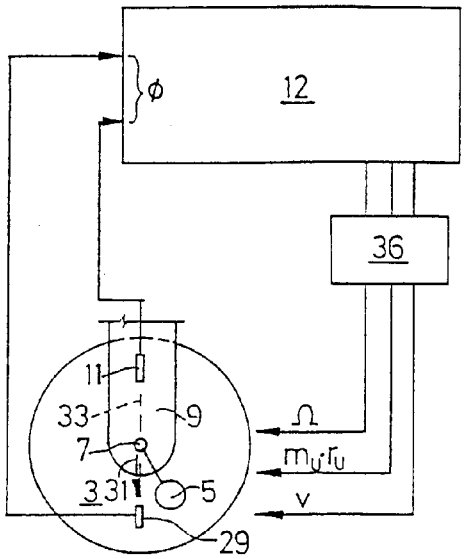

The surface 3, as shown schematically in the FIGS. 2 and 3, features a rotating unbalance with adjustable static unbalance moment $m_u \cdot r_u$. The unbalance moment is adjusted by modifying the radial unbalance distance $r_u$ of the unbalance 5. Adjusting the moment of inertia and of the frequency f is described below. To simplify the following remarks, let us assume the mass $m_u$ of the unbalance is arranged punctiformally, rotating at a distance of $r_u$ from the axis of revolution 7 of the surface 3. The static unbalance moment is therefore $m_u \cdot r_u$[kg·m]. An acceleration recorder is positioned vertically above the axis of revolution 7, on the side of a support bracket 9 of the surface holding fork 10. The acceleration recorder 11 is able to measure the acceleration values of surface 3 in a vertical direction. The acceleration recorder 11 is connected with an arithmetic unit 12 in terms of signals, which determines the oscillation amplitude a of the surface 3 by performing double integration. The surface holding fork 10 is connected with the machine chassis 15 by way of spring and damping elements 13 and 14. The spring and damping elements 13 and 14 are designed in such a way that the dynamic forces inside the damping element 14 are considerably smaller than the static forces.

With the method according to the invention for the purpose of achieving optimal, in particular, homogeneous ground compacting, the movement and/or the acceleration of the surface 3 is measured with the acceleration recorder 11, as indicated above. The vibration of the surface 3, excited by the unbalance 5, can be expressed mathematically with the following equation [1]:

$$X_d(t)=a_{1/2}\cos[(\Omega/2)t+\delta_{1/2}]+a_1\cos[\Omega t+\delta_1]+a_{3/2}\cos[(3\,\Omega/2)t+\delta_{3/2}]+a_2\cos[2\,\Omega t+\delta_2]+a_{5/2}\cos[(5\,\Omega/2)t+\delta_{5/2}]+a_3\cos[3\,\Omega t+\delta_3]$$

In this formula the index 1 indicates an allocation to values, which have the same radian frequency Ω (Ω=2 πf, which f being the frequency of the unbalance 5), as the exciting vibration of the unbalance 5. ½ refers to half the radian frequency Ω, 3/2 refers to one and one half of the radian frequency, and 5/2 refers to two and one half of the radian frequency Ω. a is the maximum amplitude value of the relevant partial oscillation. δ refers to the allocation of partial oscillations to each other in terms of phases.

With the Fourier analysis, and in accordance with the above equation, the partial frequencies can be determined by the arithmetic unit 12 on the basis of the acceleration signal. Depending on the required compacting procedure, the static unbalance moment of the unbalance 5 and its frequency f is now adjusted differently:

a) If the surface 3 always maintains contract with the ground, essentially, only the rotational frequency 1·f of the surface is determined with the Fourier analysis. This compacting procedure is called load operation.

b) If the surface 3 periodically lifts off the ground, which in comparison to a) results in more effective compacting, the Fourier analysis is used to determine harmonic oscillations, i.e. radian frequencies of 2Ω, 3Ω, . . . with drastically decreasing maximum amplitudes. The lift-off of the surface 3 from the soil is characteristic of the optimal mode of operation because in this case the forces transferred upon the soil are more effective than in case a), which results in more effective compacting.

c) If the machine, i.e. the entire roller 1, shows signs of jumping, which means the machine chassis 15 is beginning to exhibit vibrations around its steady position, the upper harmonic waves are joined by oscillations with half the exciting radian frequency Ω of the unbalance 5, i.e. plus (½) Ω, (3/2) Ω, (5/2) Ω, . . . This condition is not stable, and may potentially loosen the graded and tampered soil. Moreover, the machine chassis 15 may begin to vibrate around its longitudinal axis.

In accordance with the equivalent circuit diagram in FIG. 2, the soil 20, which is to be graded and tampered, is depicted as a spring 17 and a damping element 19. This means a soil grading and tampering system which consists of a surface 3 with oscillation exciting unbalance 5, the spring element 17, and the damping element 19 of the soil 20, that is to be compacted, and the spring element 13 and the damping element 14 between surface 3 and machine chassis 15, shows signs of self-oscillation. This is confirmed by the measurement curves shown in FIG. 4. The abscissa represents the oscillation radian frequency Ω of the surface 3, and the ordinate represents the measured maximum oscillation amplitude. However, the oscillation radian frequency Ω is standardized to the resonant frequency $w_0$ of the soil grading and tampering system, and the value a is standardized to a value $a_0$. The static unbalance moment is the curve parameter [the product of a punctiformally arranged, imagined unbalance mass $m_u$ and the radian distance $r_u$ to the axis 7]. The unbalance moment of the curve 21*a* is smaller than the unbalance moment of the curve 21*b*, etc. Above curve 23 the roller 1 begins to jump [case scenario c]. Therefore, during compacting operation the curve 23 must not be exceeded. The group of the resonance curves 21*a* through 21*d* represents an essential identification value with respect to the behavior of the soil grading and tampering system during operation. As shown below, the various influences of the machine parameters and the basic step-by-step process of the compacting operation can be derived from the curves. Compacting is optimal when the soil grading and tampering system, consisting of the compacting device that is to act upon the soil to be compacted 20, and the actual soil to be compacted 20, resonates. Optimal operation is reached when the process can be carried out with the greatest speed and the least energy.

The resonant frequency $w_0$ of the soil grading and tampering system is the square root of the quotient of the soil rigidity $C_B$ [MN/m] and the weight $m_d$ [kg] of surface 5:

$$w_0=(c_B/m_d)^{1/2}$$

In the above equation a share of the respective wheel support as well as mathematical "shares for the soil" must be added to the weight of the surface 5. However, at a maximum these additional shares are only 10% of the surface's net weight. Preferably, these shares are determined by trial and error and may be neglected for the purpose of a general approximation. Normally, the soil rigidity $C_B$ is between 20 MN/m and 130 MN/m. The soil rigidity is established according to the invention, as described below. The easiest way to measure the resonant frequency $w_0$ is by running the device across the soil 20 with a small static unbalance moment in accordance with curve 21*a*. The frequency of the unbalance 5 at the maximum curve value of 25 of $a/a_0$ indicates the resonant frequency $w_0$. The standardized amplitude value of $a/a_0=1$ is at that point where the curve 27, which connects the maximum values of the curves 21*a* through 21*d*,starts going off to the left. The amplitude value of $a_0$ can be approximated based on the following formula $$a_0=(m_f+m_d)g/c_B \qquad [2]$$

provided the surface 3 does not lift off (case scenario b). However, this is not the case here. $m_f$ is the load of the machine chassis 15 per surface 3. g is the Earth's acceleration due to gravity with g≈10.

A position sensor 29 is arranged, fixed in relation to the support bracket 9, next to the acceleration recorder 11, and it determines the time the rotating unbalance 5 passes through its minimum point (=direction of compacting). Passing this point is identical with the point in time the maximum unbalance force is directed against the soil 20. The maximum force acting upon the soil 20, is transferred by the surface 3 into the soil 20; this process takes place accompanied by a phase displacement at an angle of ø. This means, in effect, that the phase displacement ø reflects the position of the exciting oscillation from the unbalance 5 in relation to the oscillation of the soil grading and tampering system.

Figure 4:
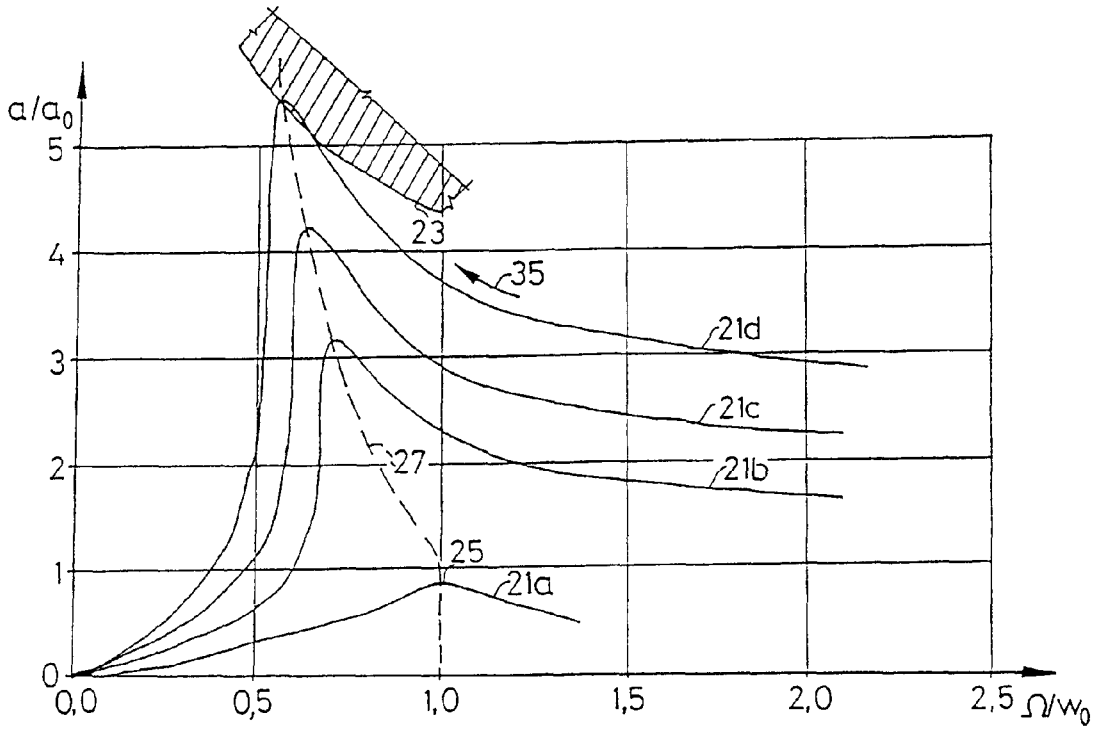

Maximum compacting force in the soil 20 is achieved if the soil grading and tampering system resonates. Resonance of the grading and tampering system always occurs at the maximum values of the curves 21*a* through 21*d*,which are located on curve 27. If resonance occurs, there is also a phase displacement of the exciting oscillation system by the unbalance 5 in relation to the soil grading and tampering system, with ø=90°. This means optimal compacting is achieved with roller parameters [static unbalance moment $m_u \cdot r_u$ and unbalance rotation radian frequency Ω] that allow operation on the curve 27. The resonance curves 21*a* through 21*d* in FIG. 4 are recorded with constant soil characteristics. The soil characteristics, alternatively represented by spring element 17 and damping element 19 in FIG. 2, are changeable which is why the position of the resonance curves 21*a* through 21*d* may also change. As depicted in FIG. 4, the oscillation amplitude, responsible for compacting the soil 20, changes considerably in the below-resonance range [oscillation radian frequency Ω is smaller than the resonance frequency, phase angle ø is smaller than 90°]; however, in the above-resonance range [oscillation radian frequency Ω is larger than the resonance frequency, phase angle ø is larger than 90°] it changes relatively little. Consequently, for stable grading and tampering operation the above-resonance range should be chosen, and the phase angle ø should be adjusted to a value of between 95° and 110°, preferably 100°.

The adjustment of the phase angle ø is accomplished, with preset static unbalance moment $m_u \cdot r_u$,by reducing the rotation radian frequency Ω of unbalance 5. For example, on the resonance curve 21*d* movement occurs in the direction of the arrow 35. Naturally, the range in which the roller lifts off, characterized by the area above curve 23, must be avoided. Penetration into that range will be felt by the roller operator because the vibration behavior of the roller 1 will change. In terms of measuring technique, as indicated above, oscillations with half the frequency [and odd multiples] of the rotation radian frequency Ω of the unbalance 5 will occur at that point. This unstable [lift-off] operation may also be ascertained based on the fact that sequential oscillation amplitudes of the surface 3 exhibit different heights.

To achieve maximum grading and tampering results, the compacting amplitude of the surface 3 must be chosen as large as possible. For achieving a preset soil modulus of elasticity E or a preset soil rigidity $C_B$, the arithmetic unit 12 and adjusting unit 36 automatically set the necessary amplitude, as described further below.

The travel speed v of the roller 1 is also adjusted for a regular compacting operation per unit distance traveled, despite a variable rotation radian frequency Ω of the unbalance 5. The speed variable depends on the type of layer that is to be compacted. Due to a low rotation radian frequency Ω, a non-consolidated layer requires a slower travel speed v than a consolidated layer. For example, for a non-consolidated layer the travel speed is $v_u$=3 km/h with a rotation frequency of $f_u$=30 Hz, and for a consolidated layer the travel speed is $v_g$=4.5 km/h with a rotation frequency of $f_g$=45 Hz.

Figure 5:
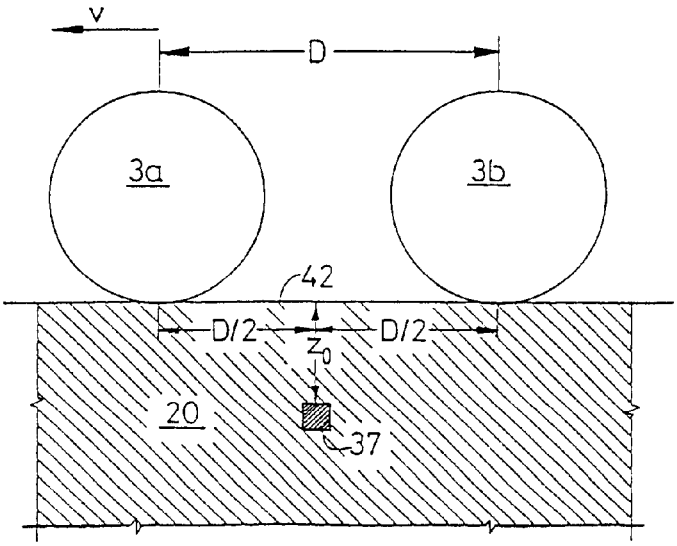
FIG. 5 the position of a soil element to be compacted in the ground.
Figure 6:
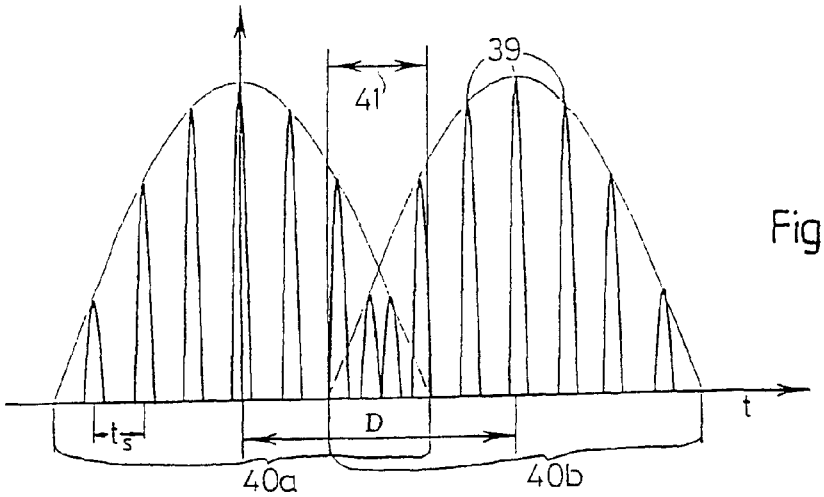
FIG. 6 a compacting force that acts upon the soil element shown in FIG. 5, FIG. 7 a start-up procedure of a soil grader and tamper device in order to achieve an optimal point of operation shown in a depiction analogous to that in FIG. 4, and FIG. 8 a schematic depiction of a gearing unit for driving two unbalances of the soil grader and tamper device with adjustable moment of inertia.

A soil element 37, as depicted in FIG. 5, depth of $z_0$, "sees" a two-surface roller 1 with a speed of v pass by during the compacting process. Depending on the location of the two surfaces 3*a* and 3*b* that roll across the soil element 37, the latter experiences, in accordance with FIG. 6, a different load peak 39. The two load processes for the two surfaces 3*a* and 3*b*, with a pulse draw 40*a* originating at the surface 3*a* and a pulse draw 40*b* originating at the surface 3*b*, can be linearly superimposed. Their effect is cumulative. Depending on the oscillation amplitude a of the soil grading and tampering system, the axis distance d of the two surfaces 3*a* and 3*b*, and the depth $z_0$ of the soil element 37 in question, a zone of overlap 41 may result, through which the ground element 37 receives parts of the loads from the surfaces 3*a* and 3*b*. During operation, the time distance $t_s$ of the partial loads acting upon the soil element 37 should be constant in order to always achieve consistent compacting quality. As described below, when the soil rigidity $C_B$ increases the roller 1, which is controlled according to the invention, will operate with a higher rotation radian frequency Ω which, consequently, results in an increase of the speed travel v. This means the compacting process is carried out with increasing speed.

In contrast to rollers and compacting procedures known in the art (e.g. WO 95/10664), grading and tampering is no longer carried out only in relation to a constant modulus of elasticity in shear but with a preset, preferably constant soil rigidity $C_B$, and, if necessary, with a preset constant modulus of elasticity E. With rollers and compacting machinery in the past it was always assumed that at least minimum compacting, as defined by the soil rigidity $C_B$ or the ground modulus of elasticity E could be achieved. The tremendous differences between minimum and maximum grading and tampering, resulting from the method known in the art, lead to the commonly known, however undesired, irregular sinking and development of unevenness of, for example, road surfaces. With the invention these differences will be avoided.

In contrast, the method according to the invention envisions compacting, for example, with a constant modulus of elasticity E. In contrast to the soils known in the art, which are compacted for minimum soil rigidity, a constant soil modulus of elasticity E results in considerably better long-term stability. It should be reiterated here that compacting is carried out on the basis of both, the preset soil rigidity $C_B$ and the preset soil modulus of elasticity E. For example, a soil 20 of a road construction, compacted with a constant modulus of elasticity, will sink evenly while it ages due to the traffic volume, and will therefore have a level surface for much longer than a road compacted in accordance with the state of the art. Roadways that were graded and tampered in accordance with the method known in the art become uneven over time due to non-homogeneous compacting; they show superficial tears and, thus, become vulnerable to destruction due to traffic and weather influences.

According to the invention, the soil modulus of elasticity E is constantly determined by roller 1, and the machine parameters are constantly adjusted; however, caution should be exercised that no dips are left behind, i.e. the soil's surface 42 is already well compacted at that point. In practical application, the exact soil modulus of elasticity E is not important until the grading and tampering process is concluded. At that time, however, the soil surface (42) has already been sufficiently compacted. The soil modulus of elasticity formula E can be derived from the following formula [3]:

$$E = C_B \cdot \frac{2(1-\mu^2)}{L \cdot \pi}\left(1.89 + \frac{1}{2}\ln\left[\frac{\pi \cdot L^3 \cdot E}{16(1-\mu^2)(m_f + m_d) \cdot g \cdot R}\right]\right) \quad [3]$$

The above equation results from a postulated continuum mechanical perspective of a curved body which is in contact with an elastic, semi-infinite area.

Since the value of interest with respect to the soil modulus of elasticity E appears on both sides of the above equation, its value must be determined with a simple iteration. To begin the calculation, on the right side of the equation, for E is put in $$E[MN/m^2]=2.3\ [1/m]\cdot C_B[MN/m] \quad [4]$$

The soil rigidity $C_B$ is determined by the arithmetic unit 12 with the assistance of the formulas a below, because that unit knows all values, or said values were set by it.

During load operation [case scenario a)], i.e. there is no lift-off by the surface 3 (this operational status applies for the amplitudes up to $a/a_0=1$), the ground rigidity $C_B$ is determined with the formula $$C_B = \Omega^2 \cdot \left[m_d + \frac{m_u \cdot r_u \cdot \cos(\phi)}{a}\right] \quad [5]$$

If the surface 3 lifts off, which is registered by the arithmetic unit 12 based on the occurrence of radian frequencies with 2 Ω, 3 Ω, . . . the arithmetic unit calculates the soil rigidity $C_B$ with the formula $$C_B = \frac{F(\text{at } \mathring{a} = 0)}{[1 - \cos(\pi^2/2K)] \cdot a} \quad [6]$$

while $$F=-m_d\cdot\ddot{a}+m_u\cdot r_u\cdot\Omega^2\cdot\cos\phi+(m_f+m_d)\cdot g \quad [7]$$

and $$K = \frac{F_{max}}{(m_f + m_d) \cdot g} \quad [8]$$

$\dot{a}$ is calculated by integration of the value measured with the acceleration recorder 11. $\dot{a}$ is the vertical speed of the surface 5. This is the surface speed that changes according to time, and should not be confused with the travel speed v. $\dot{a}=0$, i.e. a speed zero of the surface 5 is always reached in both the upper and lower oscillation cuspidal points. a is the value established by the acceleration recorder 11. The static imbalance moment $m_u \cdot r_u$[kg m] in the above formula can be determined on the basis of the unbalance 5 data. How to establish the phase angle ø has been described above. $m_d$ [kg] is known as the weight of the respective surface 3. Ω is adjusted as rotation radian frequency of the surface 3, and is therefore known. The maximum oscillation excursion a of the surface 3 can also be determined.

In formula [3] the transversal contraction number of the sub-soil is set at $\mu$=0.25 (it is between 0.20 and 0.30). L [m] is the width of the surface 3, $(m_f+m_d)$ the load each surface 3*a* and/or 3*b* is carrying, plus the respective weights of surfaces 3*a* and/or 3*b*, R [m] is the radius of the surface 3, g [=10 m/s$^2$] the Earth's acceleration due to gravity, and in the natural logarithm. Thus, all values for automatic determination of the soil rigidity $C_B$ are known, or can be determined with the arithmetic unit 12, which means that the modulus of elasticity E can also be established with the assistance of the arithmetic unit 12.

To arrive at the above formula [3] we assume that two elastic rolls are touching. The first roll has a modulus of elasticity $E_1$, a radius $R_1$ and a transversal contraction number $\mu_1$. The second roll has a modulus of elasticity $E_2$, a radius $R_2$, and a transversal contraction number $\mu_2$. Both rolls have a length L. For the surface pressure p [N/m$^2$] between the two rolls, therefore, results $$p = \frac{4 \cdot P}{\pi \cdot L \cdot b} \cdot ([1 - (4 \cdot y^2)/b^2])^{\frac{1}{2}} \quad [10]$$

P is the force acting on the first roll, b is the width of the contact surface ( L·b), in relation to which the two rolls are touching due to elastic deformation, and y is the running coordinate vertical to the axis of the roll, and with the origin of coordinates on the axis of the roll.

As transition for a roll compacting the soil (surface) we assume that the soil is the second roll described above. The radius $R_2=\infty$ is set. In addition, the modulus of elasticity $E_1$ of the first roll is considerably larger than the $E_2$ of the soil. Therefore, it is valid $$E_1 >> E_2.$$

Thus, in relation to $E_2$, it can be set $E_1 \rightarrow \infty$

The force P which acts upon the first roll is, in the context of a soil grading and tampering apparatus, a function of time. It is not temporally constant. The force P is identical with the soil reaction force F in the equations [6], [7], and [8]. Establishing the temporal mean with regard to the force P during one rotation of the surface 3 leads to $$\frac{1}{T} = \int_0^T P \cdot dt = (m_f + m_d) \cdot g \quad [11]$$

Thus, in equation [10] it is set $P=(m_f+m_d)\cdot g$. Solving the equation [10] with respect to b results therefore in $$b[m] = \left(\left[(16/\pi) \cdot \frac{(1-\mu_2^2)}{E_2} \cdot \frac{R_1(m_f + m_d) \cdot g}{L}\right]\right)^{\frac{1}{2}} \quad [12]$$

$\mu_2$ and $E_2$ are the transversal contraction and the modulus of elasticity of the soil.

Due to the elasticity of the soil $E_2$, when applying the force P, the mid point of the first roll approaches the soil's surface. This approximation δresults with regard to $$\delta[m] = \frac{P}{L} \cdot \frac{1-\mu_2^2}{E_2} \cdot E(b/L) \quad [13]$$

Since the width of the contact surface (L·b) is considerably smaller than its length L (b<<L) it is valid that $$\ominus(b/L) \approx \frac{2}{\pi} \cdot [1.89 + \ln(L/b)]$$

Also valid is (spring equation)

$$F=C_B\cdot\delta$$

and therefore $$C_B = \frac{F}{\delta} \equiv \frac{P}{\delta} = \frac{L \cdot E_2}{(1-\mu_2^2)\cdot \ominus(b/L)} \quad [14]$$

therefore it follows $$E_2 = \frac{(1-\mu_2^2)}{L} \ominus (b/L)\cdot C_B \quad [15]$$

Now b is replaced with the above value $$\ominus(b/L) = \frac{2}{\pi}\cdot\left[1.89 + \frac{1}{2}\ln\left[\frac{\pi \cdot E_2 \cdot L^3}{16(1-\mu_2^2)\cdot R_1 \cdot (m_f + m_d)\cdot g}\right]\right]$$

If equation [16] is put into equation [15], the above equation [3] results, with $R_1$=R.

For optimum grading and tampering of the soil areas to be compacted, the roller 1 must run across them several times. Due to the fact that, normally, the soil in question is not pre-compacted, the first and/or following grading and tampering runs will result in maximum compacting.

Figure 7:
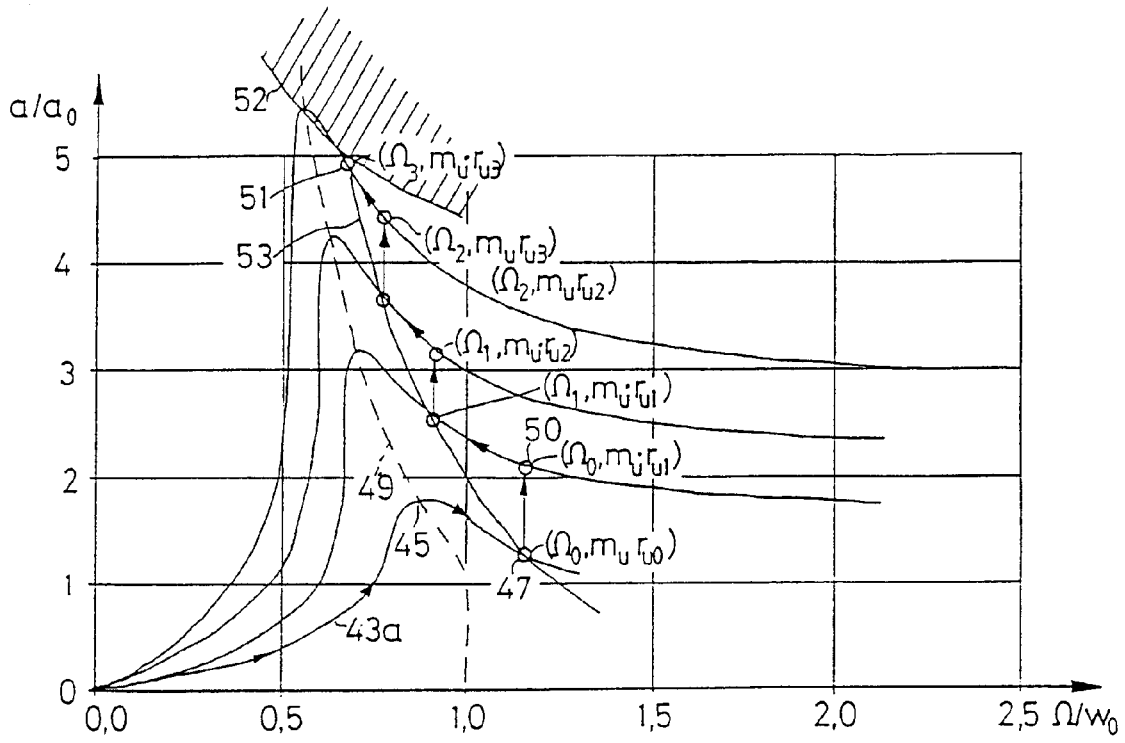

Adjusting the optimal unbalance radian frequency Ω as well as of the optimal static unbalance moment is described in FIG. 7, while, analogous to FIG. 4, the standardized unbalance radian frequency Ω [$\Omega/w_0$] is represented as abscissa value, and the standardized maximum amplitude a [$a/a_0$] of the unbalance 5 is represented as ordinate value. At the beginning of a soil grading and tampering process the unbalance 5 shows a minimum distance $r_{u0}$to the rotation axis 7 [static unbalance moment $m_u \cdot r_{u0}$]. The rotation radian frequency Ω of the unbalance 5 is increased, starting from standstill, to the value $\Omega_0$ located above the resonance of the soil grading and tampering system referred to above. The respective travel speed v of roller 1 is adjusted, in accordance with the above comments, to the rotation frequency f of the unbalance 5. The amplitude a of the surface 3 is interdependent on the rotation radian frequency Ω in correspondence with the curve 43*a*. The resonance of the soil grading and tampering system is located in point 45. This resonance point is exceeded, based on the tolerance reasons explained above, until the phase angle ø between surface oscillation and unbalance oscillation is approximately 100° [point 47]. In a next step the static unbalance moment is increased, by increasing the radial distance of $r_{u0}$ to $r_{ul}$ [$m_u \cdot r_{ul}$]. Due to the fact that the static unbalance moment is increased while the unbalance rotation frequency f remains unchanged, the phase angle ø increases to a value of above 100°, as seen by the distance of the new adjustment point 50 from the resonance curve 49 (analogous to curve 27 in FIG. 4). In a next step the rotation radian frequency of the unbalance 5 is lowered from $\Omega_0$ to $\Omega_1$, while the static unbalance moment remains constant [$m_u \cdot ru_i$], until the phase angle ø returns to 100°. The radial distance $r_u$ and the rotation radian frequency Ω are now changed alternately until the roller 1 starts to lift off. This "lift-off" is, in accordance with the comments above, noticeable at the point when odd multiples of one half of the unbalance rotation frequency occur [when curve 52 is exceeded]. The static unbalance moment $m_u \cdot r_u$ is reduced in order to reach the stable curve point 51. It is also possible to lower the unbalance radian frequency Ω, however, this type of adjustment is difficult to carry out because with this alternative two values change, i.e. the radian frequency Ω and the moment of inertia. The machine parameters allocated to curve point 51 define the conditions under which maximum grading and tampering operation is realized. The curve 53 in FIG. 7 represents the optimal adjustment curve which always ensures a phase angle ø of 100°.

After the first runs, for as long as the soil maintains its plastic properties, maximum compacting performance is reached. The plastic properties are derived from the measured values. In the "plastic range" the soil rigidity $C_B$ can only be approximated. Aware of the fact that the determination of the soil modulus of elasticity is flawed as long the sub-soil still exhibits plastic properties, it is calculated following the above explanations. When approximately 90% of the required soil elasticity value is reached, the plastic range is exceeded and the control adjusts, using the above calculation procedure, the static unbalance moment $m_u \cdot r_u$ and the unbalance rotation frequency f (unbalance rotation radian frequency Ω) in such a way that a preset soil modulus of elasticity E is reached. Using the formulas [3] and [5] the arithmetic unit 12 is able to determine during compacting the respective soil modulus of elasticity E that has already been achieved, and based on these values, for further compacting, the relevant machine parameters can be adjusted, such as static unbalance moment $m_u \cdot r_u$ unbalance frequency f and travel speed v. The adjustments are effected during the process. Adjusting the travel speed v is accomplished easily and rapidly. However, in order to adjust the static unbalance moment $m_u \cdot r_u$ in the fractional second range to a preset, determined value e.g. the process described below is used.

Instead of changing, as indicated above, the radial distance $r_u$ of the unbalance mass, two unbalances 56 and 64 running in the same direction can be used, and their mutual radial distance is adjusted by means of a planetary gearing. If the radial distance is 180°, the effective, total unbalance value is zero. At 0° the unbalance value is at its maximum. Using angle values of between 0° and 180° all intermediate values between zero and maximum unbalance mass can be adjusted.

Figure 8:
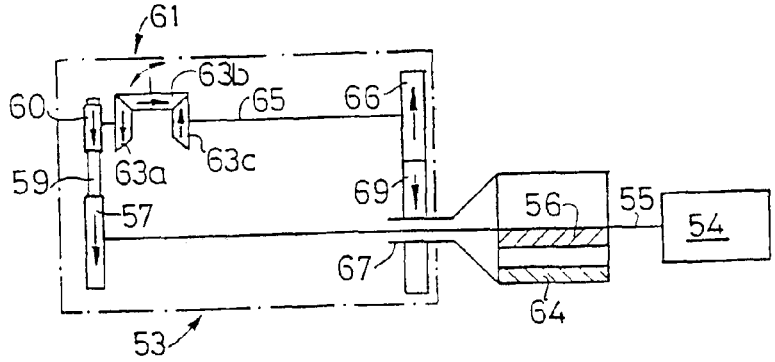

The planetary gear 53, depicted schematically in FIG. 8, serves as a drive mechanism for the two unbalances 56 and 64, which run in the same direction, and the mutual locations of which can be modified in order to adjust the static unbalance moment $m_u \cdot r_u$. In contrast to the above remarks, it is no longer the radial distance $r_u$ of an punctiformally imagined eccentric mass that is adjusted, but, with an unchanged radial distance $r_u$, the effective unbalance mass $m_u$ is now adjusted. The adjustments according to FIG. 7 are carried out on the basis of [$\Omega_0$, $m_{u0} \cdot r_{u0}$] at the curve point 47 for the following curve points with [$\Omega_1$, $m_{u1} \cdot r_{u0}$] instead of [$\Omega_0$, $m_u \cdot r_{u1}$] at the adjustment point 50, with [$\Omega_1$, $m_{u1} \cdot r_{u0}$] instead of [$\Omega_1$, $m_u \cdot r_{u1}$], [$\Omega_1$, $m_{u2} \cdot r_{u0}$] instead of [$\Omega_1$, $m_u \cdot r_{u2}$] etc. With the planetary gearing 53, depicted in FIG. 8, unbalance mass adjustments are possible in fractions of a second.

The planetary gearing shown in FIG. 8 is driven by a drive 54 via a spindle 55, which acts directly on the unbalance 56 and without any intermediate gears. On the spindle 55 a tooth lock washer 57 is arranged which acts via a toothed belt 59 on a tooth lock washer 60. The tooth lock washer 60, on the other hand, acts in conjunction with a gearing part 61. The gearing part 61 features three meshing gears 63*a*, 63*b* and 63*c*; the gear 63*a* and the tooth lock washer 60 are connected with torsional strength. The axis of the gear 63*b* can be turned radially in relation to the rotation axis of the gear 63*a*. The twisting angle is a measure for the radial torsion of the two unbalances 56 and 64, and thereby a measure for the effective total unbalance mass, or the effective static unbalance moment $m_{u0} \cdot r_u$ to $m_{u3} \cdot r_u$. On the axis 65 of the gear 63c is located a gear 66 which meshes with a gear 69 located on a hollow shaft. The hollow shaft 67 acts in conjunction with the second unbalance 64.

Since one of the two unbalances 56 and 66 is driven directly, and only the unbalance 64 is driven by the planetary gearing 53, the latter only has to transfer half of the torque. Reference point for determining the phase angle ø is the bisecting line between the centers of gravity of the unbalances 56 and 64.

It is not necessary to let the two unbalances run in the same direction with identical rotation frequencies Ω. With a corresponding selection of tooth lock washers 57 and 60 and/or the gears 66 and 69, it is possible to let one of the two unbalances run with double the rotation frequency.

The gearing described above, and as shown in FIG. 8, can also be replaced with superimposed gearing that acts identical but is constructed differently. For example, good results were achieved with the so-called "harmonic drive gearing" which reaches high one-step speed increasing ratios with only three components [wave generator, circular spline, and flex spline]. With this gearing, the circular spline is a rigid steel ring with internal toothing, which meshes into the external toothing of the flex spine in the area of the large elliptical axis of the wave generator. The flex spline is an elastically distortionable, thin-walled steel bushing with external toothing featuring a smaller partial circle diameter than the circular spline. It has therefore e.g. two fewer teeth with regard to its overall circumference. The wave generator is an elliptical disc with an open thin ring ball bearing which is inserted into the flex spine and deforms it elliptically. During the turns of the wave generator the toothing meshes with the large elliptical axis. After the wave generator has completed a 180° turn, a relative movement by one tooth occurs between the flex spline and the circular spline. After each turn that the wave generator completes, the flex spline, as drive element, turns by two teeth in the opposite direction of the drive. When this gearing is used the mechanical assembly is extremely compact.

If fill-in material is to be compacted at a construction site, it is recommended that before the material to be compacted is deposited, to establish or to test the rigidity $C_B$ of the sub-soil by one machine run across the soil. Of course, the soil modulus of elasticity E can also be determined. If the sub-soil already contains weak points, the fill-in material cannot be compacted to the extent that is necessary.

Instead of using rotating unbalances, the use of vertically oscillating unbalances, designed as piston-cylinder units, is also possible. To grade and tamper, the surfaces can be rolled across the soil 20, but it is also possible to move a vibrating plate across the soil 20.

The measuring apparatus according to the invention differs from the soil grading and tampering apparatus only insofar as the apparatus that acts upon the soil and forms an oscillation system with the latter does not essentially effect the compacting of the soil, which is in contrast to the grading and tampering device of the soil grading and tampering apparatus. This means that during the measurement procedure the force that acts upon the soil is reduced. Also, while measuring a smaller mass of the oscillating force is usually selected. The measuring apparatus according to the invention can be combined with grading and tampering devices known in the art in order to improve soil compacting operation also in conjunction with that machinery.

What is claimed is:

1. A method for measuring a mechanical characteristic of a soil using a soil compacting device and an arithmetic unit, comprising:

periodically compacting the soil using the soil compacting device so as to make the soil compacting device and the soil vibrate;

using the arithmetic unit to analyze the vibration of the soil compacting device and the soil together as a single oscillatory system having a characteristic resonant frequency Ω; and dynamically adjusting the compacting of the soil so that the single oscillatory system resonates or oscillates at a frequency exceeding the characteristic resonance frequency Ωn by a preset frequency;

wherein dynamically adjusting the compacting of the soil comprises using the arithmetic unit to automatically adjust an oscillation exciting force for driving the soil compacting device, a period frequency of the oscillation exciting force, and a phase angle (ø) between oscillation of the soil compacting device and vibration of the single oscillatory system;

so that, in view of a mass ($m_d$) of the soil compacting device and a static weight load ($m_f$) of the soil compacting device, a desired soil rigidity ($C_B$) is achieved.

2. The method defined in claim 1, further comprising:

determining a vibration amplitude (a) of the single oscillatory system by calculating a vertical movement of the soil compacting device;

adjusting a phase angle (ø) between an oscillation of the soil compacting device and an oscillation of the single oscillatory system; and generating an oscillation exciting force for driving the soil compacting device with an eccentrically located mass having a static unbalanced moment ($m_u \cdot r_u$) which is controlled by the arithmetic unit.

3. The method for compacting as defined in claim 2, wherein calculating a vertical movement of the soil compacting device includes measuring an acceleration of the soil compacting device with an acceleration gauge.

4. The method for compacting as defined in claim 2, wherein adjusting the phase angle (ø) comprises making the phase angle (ø) between 90° and 110° in lead.

5. The method for compacting as defined in claim 2, wherein the eccentrically located mass is a rotating mass.

6. The method for compacting as as defined in claim 2, comprising:

determining if a modulus of elasticity (E) of the soil has reached a threshold value using the arithmetic unit, including determining the modulus of elasticity (E) in terms of one or more of the soil rigidity ($C_B$), the vibration amplitude (a), and the acceleration of the soil compacting device.

7. The method as defined in claim 1, further comprising:

moving the compacting device relatively more rapidly across a first soil that has already been graded and tampered to a preset value than across a second soil that has yet to be compacted, wherein a reduced oscillation exciting force is used to minimize, from a compacting point of view, unnecessary runs.

8. A method as defined in claim 1, comprising:

grading and tampering non-consolidated material using a soil grading and tampering device including the compacting device in a first compacting procedure depending on soil characteristics and compacting conditions, at maximum compacting output, with output only being limited by a capacity of the machinery, with an oscillation exciting force automatically adjusted such that no lift-off of the soil grading and tampering device occurs; and determining the lift-off point of the soil grading and tampering device using a frequency analysis of the vibration of the compacting device based on an occurrence of one half of a partial oscillation component in relation to a fundamental oscillation or based on a comparison of amplitudes of sequential oscillations of the compacting device up to a preset deviation value.

9. The method as defined in claim 1, further comprising:

determining a vibration amplitude (a) of the single oscillatory system by calculating a vertical movement of the soil compacting device, and making a phase angle (ø) between an oscillation of the soil compacting device and an oscillation of the single oscillatory system between 90° and 110° in lead.

10. The method as defined in claim 1, further comprising:

determining a vibration amplitude (a) of the single oscillatory system by calculating a vertical movement of the soil compacting device, and generating an oscillation exciting force for driving the soil compacting device using an eccentrically located mass having a static unbalance moment ($m_u \cdot r_u$) which is controlled by the arithmetic unit.

11. The method as defined in claim 1, wherein the eccentrically located mass is a rotatable eccentrically located mass.

12. A measuring apparatus for measuring a mechanical characteristic of a soil, comprising:

at least one soil compacting device in contact with the soil at least some of the time, the at least one soil compacting device including at least one oscillating mass which generates a periodic force on the at least one soil compacting device, the vibration frequency (Ω) of the at least one oscillating mass being adjustable with a drive;

a measuring element which determines a point in time of a maximum oscillation amplitude ($a_0$) of the soil compacting device;

a sensor for identifying a point in time of a maximum oscillation amplitude of the oscillating mass and an arithmetic unit to analyze the vibration of the soil compacting device and the soil together as a single oscillatory system having a characteristic resonant frequency (Ω), said arithmetic unit dynamically adjusting the compacting of the soil so that the single oscillatory system resonates or oscillates at a frequency exceeding the characteristic resonance frequency (Ω) by a preset frequency, wherein dynamically adjusting the compacting of the soil comprises using the arithmetic unit to automatically adjust an oscillation exciting force for driving the soil compacting device, a period frequency of the oscillation exciting force, and a phase angle (ø) between oscillation of the soil compacting device and vibration of the single oscillatory system.

* * * * *